United States Patent [19]

Terry

[11] 4,114,688

[45] Sep. 19, 1978

[54] MINIMIZING ENVIRONMENTAL EFFECTS IN PRODUCTION AND USE OF COAL

[75] Inventor: Ruel C. Terry, Denver, Colo.

[73] Assignee: In Situ Technology Inc., Denver, Colo.

[21] Appl. No.: 857,102

[22] Filed: Dec. 5, 1977

[51] Int. Cl.[2] ..... E21B 43/24; E21B 43/26; E21C 43/00

[52] U.S. Cl. ..... 166/246; 166/259; 166/261; 166/266; 166/258; 48/DIG. 6

[58] Field of Search ..... 166/261, 259, 256, 246; 299/4, 5; 48/DIG. 6

[56] References Cited

U.S. PATENT DOCUMENTS

| | | | |
|---|---|---|---|
| 2,584,605 | 2/1952 | Merriam | 166/259 |
| 2,695,163 | 11/1954 | Pearce et al. | 166/259 X |
| 3,283,814 | 11/1966 | Schlicht et al. | 166/259 X |
| 3,298,434 | 1/1967 | Graham | 166/261 X |
| 3,599,714 | 8/1971 | Messman | 166/259 X |
| 3,734,180 | 5/1973 | Rhoades | 166/261 X |
| 3,734,184 | 5/1973 | Scott | 166/261 X |
| 3,826,308 | 7/1974 | Compere-Whitney | 166/246 |
| 3,999,607 | 12/1976 | Pennington et al. | 166/261 X |

*Primary Examiner*—Stephen J. Novosad

[57] ABSTRACT

Coal gas is produced in situ using the techniques of gasification, liquefaction and pyrolysis. Normal effluents to the atmosphere are recycled in part to the underground reaction zone for conversion into commercial products. Contaminants to underground aquifers are captured and injected into the underground reaction zone for destruction and transformation into useful products.

14 Claims, 2 Drawing Figures

FIG. 1

MINIMIZING ENVIRONMENTAL EFFECTS IN PRODUCTION AND USE OF COAL

REFERENCES

U.S. Pat. Nos. 3,924,680; 3,948,320; 3,952,802; 3,987,852; 4,010,800; 4,010,801 and 4,018,481 all of the present inventor.

U.S. Patent Application Ser. Nos. 595,335 filed July 14, 1975, now U.S. Pat. No. 4,069,868; 663,708 filed Mar. 4, 1977, now U.S. Pat. No. 4,059,151; 744,258 filed Nov. 23, 1976; 744,259 filed Nov. 23, 1976, now U.S. Pat. No. 4,089,372; 744,260 filed Nov. 23, 1976; 774,597 filed Mar. 7, 1977; 788,542 filed Apr. 18, 1977, now U.S. Pat. No. 4,092,052; 797,536 filed May 16, 1977; 801,223 filed May 27, 1977 and 834,182 filed Sept. 19, 1977, all of the present inventor.

U.S. Pat. No. 3,809,159 of Young et al.

FIELD OF THE INVENTION

The present invention relates generally to the production of coal gas in situ, and more particularly to the capture of normal effluents and contaminates which are recycled in part and converted into useful products.

BACKGROUND OF THE INVENTION

Among the many fuels indigenous to the United States, coal remains relatively abundant while other fuels such as petroleum and natural gas become increasingly more scarce. If given a choice at competitive costs, most users will select natural gas or petroleum derivatives for fuel because coal is a dirty fuel that requires extra handling steps, and even then tends to have an adverse effect on the environment.

All three fuels serve a primary use in being burned for their heat content. Such burning normally is conducted with an abundance of oxygen, resulting in the carbon content being converted into carbon dioxide, the hydrogen content into water vapor and the sulfur content into sulfur dioxide. Among these flue gases water vapor is generally considered harmless unless it is expelled in such quantities as to change the climate in the local area. Carbon dioxide, a necessity to the growth of plant life in dilute quantities, may also have deleterious effects when discharged to the atmosphere in such quantities as to become a significant portion of the air. Sulfur dioxide can react with water vapor to form sulfurous acid, a product that can have serious effects on the environment. Further, a portion of the sulfur dioxide can further oxidize into sulfur trioxide which when combined with water vapor forms sulfuric acid mists which can cause disastrous environmental effects.

Generally, natural gas and petroleum derivatives have very small quantities of sulfur contents in the order of 0.1% or less, while coal commonly contains 0.5% sulfur or more. Thus much coal, which is otherwise suitable as a fuel, may not be used as a fuel because of environmental restraints. Coal suffers another drawback in that it contains a substantial amount of non-combustible material that becomes a residue of the fire as a dry solid of powdery material or as clinker. Coal residue, in addition to causing a handling problem, also in its disposal becomes an environmental problem. Depending on how coal is fed to the fire, some or most of the ash becomes particulate matter carried in the flue gas for dispersal into the atmosphere, if not otherwise intercepted by special equipment.

A considerable amount of research and development effort has been expended in recent years directed toward the removal of particulate matter and sulfur compounds from flue gases. A substantial amount of the particulate matter may be removed by one of several means well known in the art resulting in relatively modest costs of removal and disposal. Removal of the sulfur compounds at reasonable costs is not so easily done. The most promising schemes at the current state of the art require the addition of lime or limestone to react with the sulfur compounds and thus remove a substantial portion of the sulfur from the flue gas. Unfortunately the residue of these processes is a useless material which creates still another disposal and environmental problem.

The national energy policy of the United States currently is directed toward minimizing reliance on energy supplies located outside its sovereignty. A major effort is directed toward reinstating coal to a dominant position in the domestic energy supply. With an enormous investment in pipelines and equipment designed for the use of natural gas, both industry and the population in general are faced with further substantial investments in the conversion to alternate fuels such as coal. Added investment is only part of the problem because a basically dirty fuel requires cleansing somewhere along the line to avoid serious degradation of the environment.

In the use of coal the major thrust, in the short term, is directed to clean up after the fuel is burned. In this short term approach, the emphasis is on clean up of stack gases with only a minor amount of effort directed toward making continuous operations out of traditionally batch-type operations of conventional recovery and use of coal. Thus for many years into the future the preponderance of the production work force will be consigned to underground work stations executing the batch operations of grub, sort, convey, off load and hoist. Working conditions underground, though improved in recent years, involve both hazards from instantaneous accidents and from long term exposure to contaminated breathing environments.

Working conditions for coal miners are significantly improved when coal is recovered by open cast methods. The strip mine production workers, however, continue the batch operations practices of the past after the overburden is removed and the coal grubbed out: off-load, size, sort, pile, pick up and load on transporters. The newer and larger strip mines are located in western states where bulk transportation is normally in the form of unit trains that proceed loaded to the point of use and then return empty to the mine. Most of the towns in the western states owe their origin to the coming of the railroads. Such towns typically were built with the business district on both sides of the track, a convenience of the time that did not anticipate the unit train. Currently with a score or more of unit trains passing through a particular town each day the social impact is dramatically highlighted during a period of emergency such as a building on fire, with the fire trucks on the other side of the track while a unit train lumbers through the intersection for up to five minutes.

Alleviation of the coal transportation problem has been planned in the form of long distance coal slurry pipelines. This proposed solution is controversal in several respects, not the least of which is the requirement for water as the carrier liquid for the slurry. In the arid western states the use of potable water in a coal slurry is generally considered to be an unsatisfactory use of a scarce commodity. Substituting a coal-derived liquid, such as methanol, for the slurry would be considerably less controversal. The manufacture of methanol from coal provides other benefits such as diverting to other uses natural gas currently used as a feed stock for methanol synthesis. This would provide an additional supply of natural gas for the gas distribution pipelines.

The problem of an adequate supply of natural gas to fill interstate pipelines continues to be of grave concern to gas utilities with many pipelines operating at a fraction of their capacity. With natural gas prices controlled at artificially low levels, incentives for further exploration have been depressed to the point where demand has overtaken supply with resultant shortages. With improved prices the time lag for exploration and production will perpetuate shortages for many years in the future. Since there is no assurance that enough natural gas can be discovered to satisfy demand, it would appear prudent to develop sources of synthetic natural gas (SNG) independent of conventional petroleum.

An interim solution to the natural gas shortage has been undertaken in the form of imported liquefied natural gas (LNG). Aside from the problem of a distant source, LNG introduces other problems in that to become liquid, natural gas must be cooled below its vaporization temperature, an inconvenient temperature in the order of −260° F. At this temperature natural gas is a liquid occupying approximately 1/600th of its original volume, a more convenient size for long distance transportation. Compacting energy in this manner introduces environmental hazards, particularly fire hazards should a rupture occur. One such disaster has already occurred in the U.S., with a substantial loss of life and property.

It would appear that a better approach to the natural gas supply problem is the synthesis of SNG from coal. Several projects have been proposed that would use the well known Lurgi system for gasifying coal in above ground facilities. Such a system relies on mining coal in the conventional manner, crushing coal to a predetermined size, then introducing the sized coal into the gasifier. The resultant SNG is readily interchangeable with natural gas of petroleum origin. Sizing the coal generates a substantial amount of fines that are unsuitable for the Lurgi system, therefore a market must be found for the fines, logically an adjacent coal-fired steam electric generating plant. The coal mine, the Lurgi plant and the electric plant place a heavy load on the environment in the general area of their sites. The Lurgi plant, with a water requirement of approximately one pound for each pound of coal consumed, together with the electric plant and its requirement for water results in a substantial withdrawal from the local water supply.

An even better approach would appear to be the synthesis of SNG from coal in situ. Such an approach avoids the problems of upheaval of the topsoil inherent in strip mining, the hazards of man power underground in conventional deep mining, the ash disposal problem inherent in consuming coal above ground, and the like. There are many coal deposits in the western states that lend themselves to in situ techniques, a method of producing coal that has been in commercial practice in Russia for several decades. While the Russian approach to producing coal in situ is not known for synthesis into SNG, opting instead for low BTU gas as a fuel, innovations to the Russian system can produce synthesis gas which is readily converted into SNG using well established technology.

Water requirements for the Lurgi system are dictated in part by process needs and in part by the need to keep metal parts within temperature limits. Since the in situ reaction zone is within the coal bed underground there is generally no requirement for water to limit temperatures. Thus there are many western subbituminous coals with relatively high water content in the coal itself that satisfy the process needs for water without a requirement for outside supplies.

In situ techniques are deceptively simple, a fortuitous circumstance since the reaction zone is underground away from the eye of the operator. With a simple process, considerable latitude is granted in the control of the desired processes. The processes may be conducted sloppily as compared to aboveground processes, yet be conducted safely and within planned tolerances. While in situ techniques do not eliminate environmental problems a proper practice of in situ techniques in concert with aboveground techiques can minimize environmental impacts as compared to other methods of recovering and utilizing coal.

INTRODUCTION

Producing coal gas in situ closely parallels the oil field approach to petroleum production. Wells are drilled from the surface of the earth into pay zone, which in the case of coal is a coal seam and for petroleum, a reservoir. In both cases all man power required remains aboveground, resulting in a safer and more healthful working environment as compared to conventional coal gas mining. Both in situ coal gas production and petroleum production result in recovery of useful products in fluid form, a form that lends itself to movement within the confines of flow lines and pipelines, an environmentally cleaner way compared to handling dusty coal from conventional coal mining. Production wells, both for in situ production of coal and for petroleum production, disturb a relatively small amount of ground, thus substantially reducing the restoration work at the end of the production project. In the case of an abandoned oil field, it is generally relatively difficult to find the site several months after abandonment without the aid of a map and plat.

Petroleum production in the early stages is relatively more elementary than the production of coal in situ because petroleum is already in fluid form, while coal must be converted to fluid form by gasification, pyrolysis and liquefaction. In situ production of coal has a better record of resource recovery with recoveries in the order of 80% or higher compared to petroleum with recoveries in the order of 30%.

Converting coal into fluidized form is as simple as setting it on fire underground and keeping the fire fed with an oxidizer such as air. The reliability of this process is amply demonstrated in nature with hundreds of coal fires currently burning unattended in underground coal seams. Such fires are an environmental hazard since they are unplanned, uncontrolled, and are consuming valuable resources for no useful purpose. Using the same procedures as occurs in nature and by applying rudimentary controls the underground coal fire generates a host of useful products.

There are many methods available for use in converting coal from a solid to a fluid in situ. In so doing one of the undesirable constituents of coal — moisture content — is converted to a useful constituent by entering into the underground reactions. Another undesirable constituent — non-combustible mineral matter — is reduced to ash and left in place underground. In so doing two adverse environmental effects are overcome in part. When coal is transported from a conventional mine the water content and the non-combustible mineral content accompany the coal in transit, adding weight and consequently adding cost to the movement of coal for no useful purpose. At the destination and upon combustion of coal the water escapes to the atmosphere while the non-combustible mineral matter steals heat from the fire and remains on hand as a disposal problem.

A coal fire, whether aboveground or underground, burns in an oxidizing environment, a reducing environment or a combination of the two. Although there are generally only three fuels involved — carbon, hydrogen, and sulfur — the manner in which they combine at a given instance can involve a complex series of chemical reactions. When the reactions stabilize they can be expressed in simple terms:

1. $C+O_2 = CO_2+$ heat
2. $2H_2+O_2 = 2H_2O +$ heat
3. $S+O_2 = SO_2 +$ heat
4. $C+\frac{1}{2}O_2 = CO +$ heat
5. $S+H_2+$heat $= H_2S$
6. $CO_2+C+$heat $= 2CO$
7. $C+H_2O+$heat $= CO+H_2$
8. Coal + heat = mixed coal chemicals (liquid & gas) + char + $H_2O$ The first three reactions above are of interest when heat is the desired end product, such as converting water to steam. Reaction 4 is of further interest because in addition to producing heat, carbon monoxide also is produced. Carbon monoxide is an excellent fuel gas containing over 300 BTU per standard cubic foot and is an excellent feedstock for synthesis gas. Of the two sulfur reactions, reaction 5 is preferable to reaction 3 because hydrogen sulfide is much easier to remove from the exit gas (sometimes called flue gas). Reaction 6 is of particular interest because it provides a means of taking carbon dioxide that normally would be vented to the atmosphere, then reacting it with hot carbon underground to form carbon monoxide. Diverting carbon dioxide in this manner is an environmental improvement over venting that also yields a useful product. Reaction 7 is of prime interest because two essential feedstocks for synthesis gas are generated, and because water contaminated with acids and sulfur compounds can be used in the reaction, as will be more fully described hereinafter. Reaction 8 is of interest since it occurs adjacent to the fire zone and because of the addition of heat in the absence of oxygen, yielding medium BTU gases and valuable coal chemicals.

The coal fires in nature, previously discussed, occur in coal seams above the water table and are therefore difficult to extinguish prior to resource exhaustion or prior to burning down to the water table. It therefore follows that deliberate burning of coal underground, such as in situ production of coal, should be conducted in seams below the water table. Many of the coal seams in the western part of the United States are aquifers and thus are an integral part of the water table. In order to undertake in situ production of coal in such seams it is necessary first to dewater the seam in a localized area in order to initiate combustion. Once combustion is underway water can be excluded from the reaction zone underground by raising the pressure above that of the hydrostatic head pressure, or water can be permitted to encroach into the reaction zone by lowering the pressure. Reactions can be terminated at will by the simple expedient of permitting ground water to quench the reactions, thus providing positive control over the possibility of a runaway burn and the harmful environmental problem such a burn would entail.

The reactions planned to be conducted in the reaction zone underground can have adverse environmental effects. The coal's water content, which generally has no commercial value, is consumed in the reactions and thus is unavoidably removed from the local supply of water. This adverse effect is partially offset by reaction 2 described heretofore which produces water in vapor form, which, in turn may be condensed in surface facilities. As mentioned previously carbon dioxide, normally vented to the atmosphere, can be recycled into the reaction zone in accordance with reaction 6 above, thus mitigating some of the environmental effect in discharging carbon dioxide to the atmosphere. Sulfur dioxide, as generated by reaction 3 above, is an undesirable contaminant to the atmosphere. When the reaction zone underground is operating in a predominantly reducing environment, flue gas containing sulfur dioxide can be recycled into the reaction zone, reducing the sulfur dioxide to hydrogen sulfide which in turn can be processed to elemental sulfur or other sulfur products in above ground facilities. In this manner a portion of the sulfur dioxide can be recovered as a useful product thus minimizing the effect of an undesirable affluent.

A potentially more serious problem from an environmental point of view is the probability of contaminating ground water with water soluble contaminants from the underground reaction zone. The most troublesome of the contaminants are ammonia which may be produced in association with reaction 8 above, and other water solubles generated in minor side reactions that may occur in the reaction zones such as phenols and sulfates. Water migration underground generally is of quite low velocity with natural movement of less than 100 feet per year not being uncommon. Water velocities into the reaction zone upon lowering mine pressure are much higher, although such faster movement is generally limited to the water located up dip from the reaction zone. Contaminated water up dip from the reaction zone generally is relatively small in volume and can be consumed by permitting its migration downdip into the reaction zone. Contaminated water downdip requires special procedures.

Fortunately the virgin coal seam, with its relatively high carbon content, is a natural water purifier in that contaminants are removed from percolating water by adsorption onto the exposed surfaces of the coal. Such adsorbtion has its limits in a confined geographical limit such as the property line limit. Thus it is desirable to place water interceptor wells into the property limit barrier pillar, particularly when in situ production approaches the barrier pillar. These water interceptor wells are used to draw down the water table within the barrier pillar, delivering the produced contaminated water to in situ production wells for injection into the reaction zone. In cases of unusually high water contamination it may also be desirable to emplace cultures of micro-organisms into the water bearing coal seam located within the barrier pillar. Such emplacement can be accomplished by reversing the flow of the water interceptor wells. The microorganism species are selected from those known to thrive on the contaminants involved and more particularly those species that expire when contaminants are completely consumed. In these manners water contamination can be kept within acceptable limits.

Production of coal gas in situ generates large volumes of gases. In the preferred methods of the instant invention the bulk of the gas generated is either low BTU fuel gas or water gas. For process continuity purposes these gases need to be stored temporarily in support of aboveground processing facilities as will be more fully described hereinafter. In the ideal case the coal field to be produced would overlie two depleted petroleum reservoirs. The petroleum reservoirs would be depleted in the economic sense, with up to 70% of the petroleum locked in place underground. The petroleum production wells would have been plugged at the time of abandonment, and upon re-entering would serve as gas storage wells for the in situ coal gases. The upper petroleum reservoir typically could be a hundred feet below the coal deposit and the lower petroleum reservoir could be 100 or more feet below the upper petroleum reservoir. From the coal project low BTU gas would be compressed and delivered to undergound storage in the upper petroleum reservoir. Water gas, likewise, would be stored in the lower petroleum reservoir. Both gases could be withdrawn as required under their own pressures for delivery to aboveground processing equipment. With a sufficient amount of both gases in storage, aboveground processing equipment can be operated at the planned rates without regard to the expected variations in production rates for the two gases.

As is well known in the art, both low BTU fuel gas and water gas are miscible in liquid crude petroleum. As gases they have the capability of penetrating into areas of low permeability and porosity in the host rock of the petroleum reservoirs. Petroleum trapped in the so called tight portions of the reservoir is invaded by the gases which are taken into solution by the residual petroleum. The resulting solution is much thinner than the original residual petroleum and is capable of moving through areas of permeability that previously were barriers to such movement. The thinned petroleum generally will not move until a drive is established. Such drive is provided when the stored gas is withdrawn under its own pressure for use in aboveground processing equipment. A portion of the residual petroleum will accompany the gas to the aboveground location where it will be necessary to separate the petroleum from the withdrawn gases. Such separation is accomplished in separators commonly used in the petroleum industry, with the gas directed to its intended use and the petroleum diverted to market. Petroleum produced in this manner results in an added bonus to the economics of in situ coal production.

The low BTU gas of the instant invention, generally in the range of 75 to 200 BTU per standard cubic foot, is mixed in storage facilities to yield a composite gas in the order of 140 BTU per standard cubic foot. This gas is used on site to raise steam for the processes and to generate power for on site use, with gas surplus to the needs of the project being marketed either as gas or in the form of electricity. The water gas of the instant invention, composed principally of equal parts of hydrogen and carbon monoxide, is directed to aboveground clean up facilities where impurities are removed. From clean up facilities the purified water gas is directed to a conventional steam reformer, where the ratio of carbon monoxide to hydrogen is adjusted by the following reaction:

9. $CO + H_2O = H_2 + CO_2$

The hydrogen already present in the water gas is augmented by the hydrogen generated in the above reaction 9, then by removing $CO_2$ in a manner well known in the art, the ratio of carbon monoxide to hydrogen can be adjusted to form a synthesis gas for any of several planned end products. With a ratio of 1:2 methanol can be produced. With a ratio of 1:3 methane can be produced. The carbon dioxide removed from the steam reformer can be used by recycling to the underground reaction zone or to an aboveground gasifier.

The methanol thus produced can move to market by pipeline or surface transportation, or it may be used as the carrier liquid for a coal slurry pipeline. Methanol used as a slurry pipeline carrying agent could also be used to move fines from Lurgi operations or fines from stripping and crushing operations of coal intended for rail shipment — all located in the same general area. The methane that is synthesized is readily interchangeable with natural gas of petroleum origin and is moved to market through pipelines.

SUMMARY OF THE INVENTION

Figure 1:
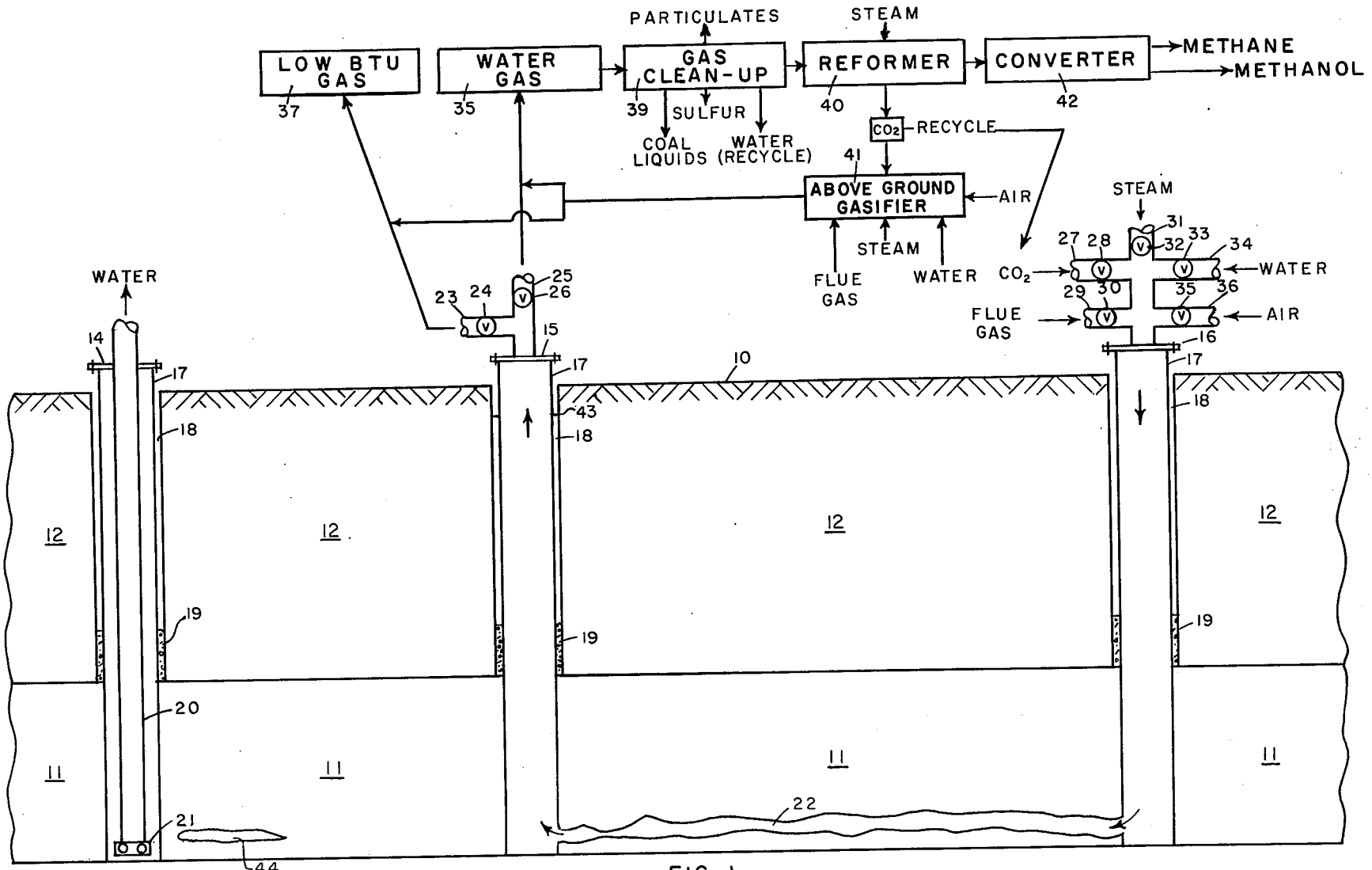
FIG. 1 is a diagrammatic vertical section taken through the earth showing three types of wells used in the methods of the present invention, together with associated facilities normally located aboveground and shown in block form.

An underground coal deposit is fluidized in situ using at least one injection well and one withdrawal well drilled from the surface of the earth into the coal deposit. The wells are linked together with a channel through the coal, the channel preferably being formed by burning so that a portion of the coal is heated to a temperature above its ignition point temperature. An air blow is initiated and continued until a substantial amount of the coal along the underground channel is incandescent. The air blow is terminated and followed immediately by a two part steam run. The first part of the steam run continues until the underground circuit is substantially purged of the air blow gases. The air blow gases and the steam run gases to this point in the sequence are commingled in a first storage facility. The sequence continues with the second part of the steam run, with the generated water gas directed to a second storage facility.

Preferably the first storage facility is a first petroleum reservoir located approximately 100 feet below the coal deposit, and the second storage facility is a second petroleum reservoir located approximately 100 feet below the first petroleum reservoir. The resulting low BTU gases are stored temporarily in the first petroleum reservoir where the air blow gases and the first segment of the steam run gases are commingled to form a composite gas of relatively stable BTU content.

The resulting water gas from the second segment of the steam run also is stored temporarily in the second petroleum reservoir. During the later stage of the second segment of the steam run a portion of the injected steam does not enter into the reaction and this unreacted steam accompanies the water gas to storage, where upon cooling the steam condenses to water.

Preferably, prior to employing the methods of the present invention, both petroleum reservoirs would have been produced to economic depletion with approximately 70% of the petroleum remaining locked in place. Both the low BTU gas and the water gas are miscible in petroleum, and the gases upon injection under pressure into each petroleum reservoir will disperse through the permeability and porosity of the host rock. In so doing the pressure of the petroleum reservoirs is increased and the gases are absorbed by the petroleum. The absorbed gases thin the petroleum and enhance its flow characteristics. Heat released by the condensing of water vapor carried by the low BTU gas and the steam carried by the water gas also improve the flow characteristics of the petroleum.

An abundant supply of both low BTU gas and water gas is placed in storage so that a constant supply of each gas may be withdrawn under its own pressure to support aboveground processes without regard to variations in the day to day production of the gases. The petroleum locked within each reservoir has been treated as described above and in effect has been restored to reservoir status with a gas drive. Upon withdrawal of either the low BTU gas or the water gas, a portion of the petroleum, as well as the residual water, will accompany the gases to the surface of the earth. Standard separator facilities commonly used in petroleum production are provided at the surface to separate the fluids. The dried low BTU gas is used to raise steam and generate electricity in surface facilities. The dry water gas is directed to surface facilities for synthesis into other products. The petroleum is saved and marketed. The recovered water is recycled as a reactant in underground coal in situ processes.

In an alternate embodiment the underground coal is subjected to an air blow until a portion of the coal is incandescent. The air blow is terminated and followed immediately by reinjection of the gases generated by the air blow. In this manner a considerable amount of carbon dioxide, as well as sulfur dioxide, that otherwise would be vented to the atmosphere is recycled into the underground reaction chamber where the carbon dioxide is reduced to carbon monoxide and the sulfur dioxide is reduced to hydrogen sulfide. The resulting carbon monoxide is then used as a low BTU fuel gas or as an ingredient of synthesis gas. The hydrogen sulfide is removed from the gas stream and converted to elemental sulfur for market. In both cases gases which normally would be polluting affluents to the atmosphere are recycled and converted into useful products.

Adjacent to the underground reaction zone in the coal small quantities of water soluble products are absorbed by the water content of the coal formation. These pollutants — phenol, ammonia, and sulfates — expelled up dip from the reaction zone will ultimately be consumed in the reaction zone. Those pollutants expelled on strike and down dip from the reaction zone may escape unless intercepted by other means. Water interceptor wells are drilled in the barrier pillar along the property line on strike and down dip. Water produced from the interceptor wells is reinjected into the underground reaction zone where the water enters the reactions and the pollutants are converted into other products.

In surface facilities the water gas is directed to clean up facilities where impurities are removed. The purified gas is then sent to a conventional reformer for reaction with steam to adjust the rates of carbon monoxide to hydrogen. In one case the ratio is adjusted to 1:2 and the synthesis gas is converted to methanol. In another case the ratio is adjusted to 1:3 and the synthesis gas is converted into methane. A byproduct of the reformer step is carbon dioxide which is removed from the feed stream by conventional methods. The carbon dioxide thus removed, rather than being discharged to the atmosphere, is recycled in one case to an aboveground coal gasifier and in another case to the reaction zone in the underground coal.

DESCRIPTION OF THE PREFERRED EMBODIMENTS

Referring first to FIG. 1, an injector well 16, a withdrawal or producer well 15 and a water interceptor well 14 are shown drilled from the surface of the earth 10 into a coal formation 11. A casing 17 is set in each well and each casing is cemented 19 into place to form an hermetic seal. The space 18 between casing 17 and the bore hole may be left open or it may be filled with a column of fluid as shown at 43 in well 15. In some cases the column of fluid may be necessary to maintain the hermetic seal when the mine pressure is increased in reaction zone 22 in the coal 11. Wells 15 and 16 are in fluid communication through the coal 11 by reaction zone 22. Reaction zone 22 may be created in any convenient manner, but preferably is created by the reverse burn linkage procedure common in the production of coal in situ. By creating the linkage in this manner that portion of coal 11 abutting on channel 22 (sometimes called the reaction zone) is at a temperature above its ignition point temperature, and thus will burn when a source of oxygen is injected into channel 22. If channel 22 is created in another manner, for example hydraulic fracturing, then it will be necessary to ignite the coal and then burn the coal for a period of time necessary to increase the temperature along channel 22 to a point above the ignition temperature of the coal.

The overburden 12 in the ideal case is a competent rock formation that is impervious to the passage of gases. Preferably overburden 12 is of sufficient thickness, for example 100 feet or more, to contain the desired mine pressure in channel 22, for example 50 psig or higher.

Injection well 16 has a suitable well head or christmas tree to permit the injection of a variety of fluids useful in the processes of the present invention. For example with all valves closed, valve 32 may then be opened to inject steam into reaction zone 22. In a similar manner, valve 33 may be opened to inject water, valve 35 may be opened to inject air, valve 30 may be opened to inject flue gas, and valve 28 may be opened to inject carbon dioxide.

Production well 15 (sometimes called a withdrawal well) is equipped with a suitable wellhead to permit recovery of the products of the underground reactions (sometimes called flue gas or exit gas). Planned mine pressure in reaction zone 22 may be stabilized by operating valves 24 or 26 in concert with injected fluids from well 16. Well 15 as shown is designed to produce either low BTU gas or water gas. Other fluids could be withdrawn through well 15 with minor modifications to the wellhead.

Water interceptor well 14 has a primary purpose of drawing down the water table in coal 11 and therefore requires only a pump 21 located near the bottom of coal seam 11. Well 14 may also be used to inject microorganisms 44 into the coal 11 when it is desirable to destroy water pollutants by this method.

As shown in FIG. 1 low BTU gas is produced. A further description of the handling of the low BTU gas is described hereinafter. Water gas produced is directed to other aboveground facilities which are shown in block form. The produced water gas is first directed to the gas clean up unit 39 where particulate matter is removed, coal liquids are separated and saved, water is removed and recycled into reaction zone 22, and sulfur compounds are separated and removed. The purified water gas (carbon monoxide and hydrogen) is then directed to the reformer unit 40 where in reaction with steam the carbon monoxide to hydrogen ratio is adjusted to form synthesis gas. The byproduct of the reformer unit is carbon dioxide which is removed from the gas stream by methods well known in the art. Carbon dioxide recovered from the reformer unit is then directed to the reaction zone 22 via well 16 or is directed to a conventional aboveground coal gasifier 41, in both cases the carbon dioxide is reduced by reaction into carbon monoxide.

Figure 2:
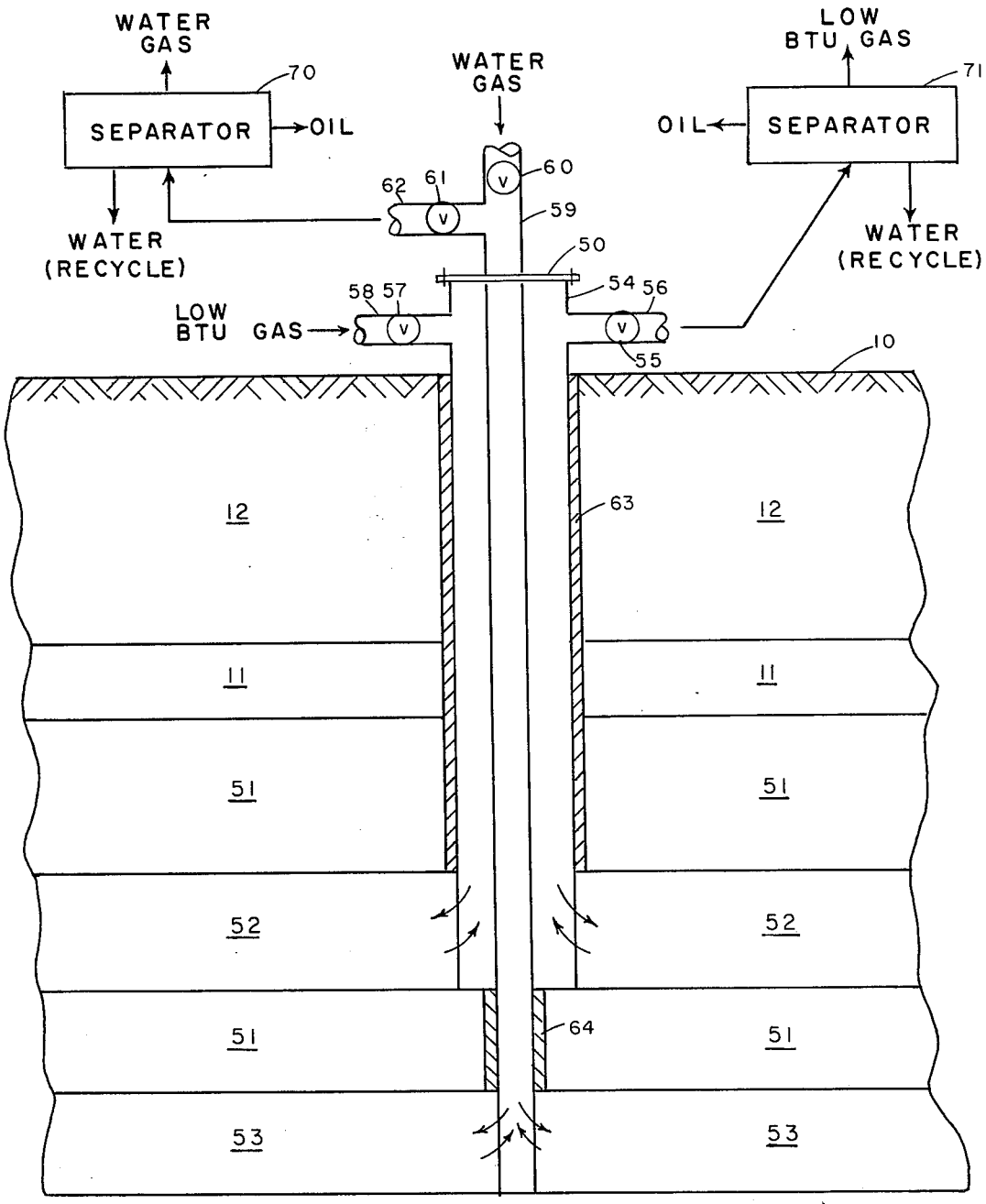
FIG. 2 is a diagrammatic vertical section taken through the earth showing a gas storage well used in the methods of the present invention, together with associated facilities normally located aboveground, shown in block form.

Referring now to FIG. 2 a gas storage well 50 is shown. Well 50 has been drilled from the surface of the earth 10, through overburden 12, coal 11, interburden 51, petroleum reservoir 52, interburden 51 and bottomed in petroleum reservoir 53. Well 50 is cased with casing 54 which preferably is bottomed at the top of petroleum reservoir 52. In some cases it may be preferred to bottom casing 54 at the lowermost portion of petroleum reservoir 52, in which case it will be necessary to perforate casing 54 (not shown) in the interval of the well represented by petroleum reservoir 52. Casing 54 is set in place preferably by cementing 63. A tubing 59 is set within casing 54 and is extended preferably to the top of petroleum reservoir 53. Tubing 59 could be extended to the bottom of petroleum reservoir 53 if desired provided suitable perforations (not shown) are provided in the interval represented by petroleum reservoir 53. Tubing 59 is hermetically sealed 64 in any suitable manner, but preferably by cementing. Well 50 contains suitable wellhead fittings to permit injection and withdrawal of fluids. As shown low BTU gas from reaction zone 22 (FIG. 1) is injected through flow line 58 containing valve 57 and is withdrawn through flow line 56 containing valve 55. Likewise water gas is injected through tubing 59 containing valve 60 and is withdrawn through flow line 62 containing valve 61. Low BTU gas withdrawn from well 50 is directed to separator 71 where the petroleum (sometimes called oil) is separated and saved, and where the water content of the gas is separated and recycled into reaction zone 22 (FIG. 1). Water gas withdrawn from well 50 is directed to separator 70 where petroleum is separated and saved and water is separated and recycled into reaction zone 22 (FIG. 1).

In commercial practice a multiplicity of the wells 14, 15, 16 and 50, as described heretofore, would be drilled. Other surface facilities (not shown) would also be required including necessary flow lines to connect the facilities, pumps to move fluids, compressors to raise the pressure of gases, water treaters, steam generators and the like. These aboveground facilities are standard equipment in the petroleum and petrochemical industries and only serve supporting purposes to the methods of the present invention.

The process begins with a portion of the coal abutting on reaction zone 22 being at a temperature above its ignition point temperature. With all valves closed, valve 35 is opened and air is injected into the underground circuit composed of well 16, channel 22 and well 17. Injection continues until the pressure in the underground circuit comes up to planned operating pressure, for example 50 psig, at which point valve 24 is opened to the extent necessary to maintain the desired pressure within the underground circuit. The air blow continues for a period of time, for example 20 minutes, until a portion of the coal in channel 22 is at incandescent temperature, for example 2000° F. or higher. The air blow gases are captured as low BTU fuel gases, preferably by injection into petroleum reservoir 52 via well 50. In the early cycles of the air blow procedure the low BTU gases may have a calorific content in the order of 200 BTU per standard cubic foot due to enrichment caused by expulsion of pyrolysis gases into channel 22. Upon repeated cycles of the air blow the effect of pyrolysis wanes and the generated low BTU gases will have a calorific content in the order of 100 BTU or less. Such low BTU gases have a relatively high nitrogen content derived from the nitrogen in the injected air, the nitrogen generally not entering into the underground reactions.

The process continues by closing valve 35 and opening valve 32, permitting the injection of steam into the underground circuit. This steam run is continued for a period of time, for example 30 minutes. At the beginning of the steam run the underground circuit contains air and low BTU fuel gas diluted with nitrogen and water vapor. The first segment of the steam run, for example a time period of 2 minutes, is used to displace the gases associated with the air blow through flow line 23 with valve 24 open to the extent necessary to maintain desired mine pressure in reaction zone 22. The second segment of the steam run, for example 28 minutes of the run, is accomplished by closing valve 24 and opening valve 26. The second segment of the steam run generates water gas (carbon dioxide and hydrogen) and small quantities of hydrogen sulfide. The exit gases from the second segment of the steam run, as shown on FIG. 1, are directed to aboveground processing facilities, although in many cases it may be desirable to direct the exit gases first to temporary storage in petroleum reservoir 53 (FIG. 2), then withdraw the gases from temporary storage and direct them to aboveground processing facilities.

The process continues in aboveground facilities. Water gas generated in reaction zone 22 is directed to gas clean up unit 39 where impurities are removed. These impurities normally will be particulate matter, condensible coal compounds, sulfur compounds and water. The purified water gas is then directed to reformer unit 40 where it is reacted with steam in accord with reaction 9 previously described in the Introduction. In the reformer unit 40 the ratio of carbon monoxide to hydrogen is adjusted in one case to 1:2 and in another case to 1:3. Those skilled in the art will recognize other ratios that might be desired, depending on the end product to be synthesized. A byproduct of the reaction in reformer unit 40 is carbon dioxide which is separated from the exit gas stream, is saved, and recycled as described hereinafter.

The synthesis gas from reformer unit 40 is directed to converter unit 42 where in one case the gases are synthesized into liquid methanol and in another case into gaseous methane. The produced methanol is preferably used as the carrier liquid for a coal slurry pipeline delivering coal produced in conventional mines to distant markets. The produced methane is moved by pipeline as a synthetic natural gas readily interchangeable with natural gas of petroleum origin.

It will be appreciated that the periods of times for the air blow and the steam run as described heretofore are used as examples. The periods of time required at a specific locality must be adjusted with due regard to the depth of the coal seam, the length of channel 22 and the like. It will be further appreciated that the amount of particulate matter, such as fly ash and unreacted particles of coal, may vary widely depending on the quality of the coal, the velocity of the gas stream and the like. Should an appreciable amount of particulate matter accompany the gases withdrawn from well 15, it is preferable that the particulate matter be removed, for example, prior to directing the gases to storage or other uses.

The water required to raise steam or for injection into reaction zone may be obtained in part from water interceptor well 17 by the simple expedient of activating pump 21 and drawing down the water table. Preferably the water to be directed to steam generators (not shown) would be treated to remove impurities prior to use. Water from well 17 generally may be directed into well 16 without treatment. Other sources of water for the processes include water recovered from gas clean up unit 39, separator 70 and separator 71.

In a first alternate embodiment of the present invention the air blow cycle is initiated as described above which generates a low BTU gas composed of carbon monoxide, carbon dioxide, nitrogen, water vapor, sulfur dioxide and the like. In lieu of the steam run cycle, the exit gases from the air blow are reinjected into well 16 for a reducing environment run cycle. In this manner the carbon dioxide is reduced to carbon monoxide and sulfur dioxide is reduced to hydrogen sulfide. Both the carbon monoxide and the hydrogen sulfide may be removed from the exit gas stream for conversion to useful products.

In a second alternate embodiment to the present invention the air blow cycle is initiated as descibed above. In lieu of the steam run, the carbon dioxide recovered from reformer unit 40 is injected into well 16 for reducing environment run cycle. Generated gases from the reducing environment cycle may be commingled with the low BTU gas in storage, or the reducing environment run cycle may be conducted in two parts with the first part used to purge the underground circuit and the second part use to generate carbon monoxide relatively free of nitrogen dilution.

Generally the air blow cycle, when alternated with a reducing environment run cycle, will consume less than 30% of the coal available for reaction, while the repeated combination of the two cycles can consume virtually all of the coal in place. Therefore considerable latitude is afforded in the choice of injected reducing reactants: steam, water, flue gas, carbon dioxide and the like. In some cases, particularly where there is an abundance of available water in the coal seam, it may be desirable to add a conventional aboveground coal gasifier to the sequence of aboveground processes as shown in FIG. 1. Coal for the aboveground gasifier would be obtained from a nearby conventional coal mine. The aboveground gasifier could be operated with alternating cycles of air blows and reducing environment runs. Injected reducing reactants for the reducing environment run could come from the in situ processes described above including water from well 17, and water from aboveground facilities such as gas clean up unit, separator 70, and separator 71; carbon dioxide from reformer unit 40; and flue gas from well 15.

The various gases produced in the methods of the present invention may be stored in any convenient manner. Preferably the generated low BTU gas and water gas are stored separately in underground petroleum reservoirs (see FIG. 2). As examples the low BTU gas is stored in reservoir 52 and the water gas is stored in reservoir 53. Preferably the particulate matter and condensible fluids are first removed from the gas streams, then each gas is compressed to a pressure exceeding the pressure of the storage reservoir. The upper limit of the gas pressure is established by the maximum pressure the reservoir will withstand without rupturing. The ideal storage pressure would be a pressure level that would assure that substantially all of the stored gases would return to the surface of the earth when valves 60 and 55 remain open for extended periods of time.

The low BTU gas is directed to storage via flow line 58 with valve 57 open and valve 55 closed. This gas may be withdrawn from storage by closing valve 57 and opening valve 55. Preferably the withdrawn gas is directed through separator 71 where oil is separated and saved and water is separated and recycled. The dried low BTU gas is then directed to the steam generators as a fuel to raise steam or to generate electricity.

The water gas is directed to storage via tubing 59 with valve 60 open and valve 61 closed. This gas may be withdrawn from storage by closing valve 60 and opening valve 61. Preferably the withdrawn gas is directed through separator 70 where oil is separated and saved and water is separated and recycled. The dried water gas is then directed to gas clean up unit 39 where remaining impurities are removed with the purified gas continuing through aboveground processing steps as described heretofore.

Thus it may be seen that coal may be fluidized in situ with the resultant upgrading in surface facilities in such manners as to minimize the environmental impact of coal production as compared to producing and using coal by so-called conventional means. Effluents normally released to the atmosphere as pollutants are recycled in part into useful products. Contaminants to underground water supplies are substantially destroyed or converted to useful products. For the most part the end products resulting from the practice of the present invention are readily transported by underground pipelines resulting in minimum environmental impact for product transportation.

While the present invention has been described with a certain degree of particularity it is understood that the present disclosure has been made by way of example and that changes in details of structure may be made without departing from the spirit thereof.

What is claimed is:

1. A method of gasifying coal in situ in concert with gasifying coal in aboveground facilities comprising the steps of:

establishing fluid injection and fluid removal passages connecting an underground coal deposit to a surface location, establishing a communication passage through the said underground coal interconnected to the said fluid injection and fluid removal passages,
establishing an aboveground coal gasification means,
igniting the underground coal in the said communication passage,
igniting the coal in the said aboveground coal gasification means,
injecting an oxidizer in the said fluid injection passage,
injecting an oxidizer in the said aboveground coal gasification means,
gasifying the said underground coal into flue gas,
gasifying the coal in the said aboveground gasification means,
terminating the said injection of an oxidizer in the said aboveground coal gasification means,
injecting the said flue gas into the said aboveground coal gasification means, and
capturing the produced gases from the said aboveground coal gasification means.

2. The method of claim 1 further including the steps of:
terminating the said injection of flue gas,
injecting contaminated water into the said aboveground coal gasification means with the resultant destruction of contaminants, and
capturing the produced gases from the said aboveground coal gasification means.

3. A method of gasifying coal in situ wherein a portion of the underground coal deposit has been preheated to a temperature above the ignition point temperature comprising the steps of:
establishing fluid injection and fluid removal passages connecting the coal to a surface location,
establishing a fluid passage through the coal interconnected with the fluid injection and removal passages,
establishing a water withdrawal passage connecting the coal to a surface location, the water withdrawal passage being spaced apart from the fluid passage through the coal, and the water withdrawal passage being in fluid communication with an underground aquifer containing contaminated water,
injecting an oxidizer through the fluid injection passage and into the coal,
gasifying the coal,
capturing the gases through the fluid removal passage,
terminating oxidizer injection,
withdrawing water from the underground aquifer through the water withdrawal passage and injecting the water into the fluid injection passage,
gasifying the coal, and
capturing the gases through the fluid removal passage,

4. The method of claim 3 wherein the said water is water that has been contaminated with the products of reaction during the said gasifying the coal.

5. The method of claim 3 wherein the said capturing the gases is conducted in three phases,
the first phase being capturing the gases generated as a result of the said injecting an oxidizer, the gases of the first phase being captured in a first storage facility,
the second phase being the gases generated as a result of the first portion of the said injecting water, the second phase being continued until the underground circuit is substantially purged of the gases of the first phase, and the gases of the second phase being captured in the said first storage facility, and
the third phase being water gas generated as a result of the remaining portion of the said injecting water, the water gas being captured in a second storage facility.

6. The method of claim 5 wherein the said first storage facility is a first petroleum reservoir and the said second stage facility is a second petroleum reservoir.

7. A method of gasifying coal in situ wherein a portion of the underground coal deposit has been preheated to a temperature above the ignition point temperature comprising the steps of:
establishing fluid injection and fluid removal passages connecting the coal to a surface location,
establishing a fluid passage through the coal interconnected with the fluid injection and removal passages,
injecting an oxidizer,
gasifying the coal and
capturing the gases in a first storage facility;
terminating oxidizer injection, then
injecting water,
gasifying the coal, and
capturing the gases in the first storage facility,
continuing the injection of water until substantially all of the gases generated by the said injection of an oxidizer are substantially purged from the said fluid injection and removal passages and the said fluid passage through the coal, then
capturing the remainder of the gases generated by the said injection of water, in a second storage facility, and further including the steps of
drilling a water interceptor well into the said coal deposit,
withdrawing water from the said coal deposit, the said water being contaminated with the products of the said gasifying of the said coal, then
injecting the contaminated water into the said fluid injection passage.

8. The method of claim 7 further including the steps of:
terminating the withdrawal of water and
terminating injecting the contaminated water into the said fluid injection passage, then
injecting into the said water interceptor well a culture of microorganisms, the said microorganisms having the capability of consuming the contaminants dispersed in the water contained in the said coal deposit.

9. A method of gasifying coal in situ wherein a portion of the underground coal deposit has been preheated to a temperature above the ignition point temperature comprising the steps of:
establishing fluid injection and fluid removal passages connecting the coal to a surface location,
establishing a fluid passage through the coal interconnected with the fluid injection and removal passages,
injecting an oxidizer,
gasifying the coal and
capturing the gases in a first storage facility;
terminating oxidizer injection, then
injecting water,
gasifying the coal, and
capturing the gases in the first storage facility, wherein the said first storage storage facility is a first underground petroleum reservoir spaced apart from a second underground petroleum reservoir, continuing the injection of water until substantially all of the gases generated by the said injection of an oxidizer are substantially purged from the said fluid injection and removal passages and the said fluid passage through the coal, then capturing the remainder of the gases generated by the said injection of water, in a second storage facility.

10. The method of claim 9 further including the steps of:

terminating capturing the said gases in the said first storage facility, withdrawing the injected gases from the said first underground petroleum reservoir, directing the said withdrawn gases together with accompanying fluids to a separator means, separating water from the said withdrawn gases and separating petroleum from the said withdrawn gases.

11. A method of gasifying coal in situ wherein a portion of the underground coal deposit has been preheated to a temperature above the ignition point temperature comprising the steps of:

establishing fluid injection and fluid removal passages connecting the coal to a surface location, establishing a fluid passage through the coal interconnected with the fluid injection and removal passages, injecting an oxidizer, gasifying the coal and capturing the gases in a first storage facility;

terminating oxidizer injection, then injecting water, gasifying the coal, and capturing the gases in the first storage facility, continuing the injection of water until substantially all of the gases generated by the said injection of an oxidizer are substantially purged from the said fluid injection and removal passages and the said fluid passage through the coal, then capturing the remainder of the gases generated by the said injection of water in a second storage facility, wherein the said second storage facility is a second underground petroleum reservoir spaced apart from a first underground petroleum reservoir.

12. The method of claim 11 further including the steps of:

terminating capturing the said remainder of the gases in the said second storage facility, withdrawing the injected gases from the said second underground petroleum reservoir, directing the said withdrawn gases together with accompanying fluids to a separate means, separating water from the said withdrawn gases and separating petroleum from the said withdrawn gases.

13. A system of producing coal gas in situ in concert with aboveground facilities comprising in combination:

a first well drilled from the surface of the earth into an underground coal formation, the said first well including means for injecting reactants into the said coal formation, a second well drilled from the surface of the earth into the said coal formation, the said second well including means for withdrawing fluids from the said coal formation, a communication means through the said underground coal, the said communication means being in fluid communication with the said first well and the said second well, a third well drilled from the surface of the earth into the said coal formation, the said third well including means for withdrawing water from and injecting water into the said coal formation, a gas clean up means for removing from produced gas from said second well the impurities consisting of particulate matter, water, sulfur compounds, and condensible coal fluids, and a reformer means for adjusting the ratio of carbon dioxide to hydrogen in the cleaned gas stream from said gas cleanup means with a further capability of removing carbon dioxide from the daid gas stream.

14. A method of destroying contaminants in the underground water adjacent to the reaction zone of an in situ coal gasification project comprising the steps of drilling a water interceptor well from the surface of the earth into the water bearing formation containing contaminated water, injecting microorganisms through the water interceptor well into the said contaminated water, the said microorganisms having the capability of destroying the contaminants in the underground water.

* * * * *